US005666829A

United States Patent [19]

Aikens

[11] Patent Number: 5,666,829

[45] Date of Patent: Sep. 16, 1997

[54] PLUG LOCK

[76] Inventor: Isaac Aikens, 2302 Overpass Rd., Campbellton, Fla. 32426

[21] Appl. No.: 603,469

[22] Filed: Feb. 20, 1996

[51] Int. Cl.[6] ..... E05B 65/00

[52] U.S. Cl. ..... 70/57; 70/169; 403/321; 439/134; 439/135

[58] Field of Search ..... 70/169, 57, 58, 70/158–162, 173; 439/307, 318, 133–135, 141; 403/321, 322

[56] References Cited

U.S. PATENT DOCUMENTS

| | | | |
|---|---|---|---|
| 2,733,416 | 1/1956 | Evalt | 70/57 |
| 3,754,205 | 8/1973 | Lenkey | 439/141 |
| 4,340,267 | 7/1982 | Nukaga | 439/140 |
| 4,445,738 | 5/1984 | Wiencke | 439/133 |
| 4,445,739 | 5/1984 | Wooten | 439/140 |
| 4,653,824 | 3/1987 | Jason et al. | 439/134 |
| 4,812,131 | 3/1989 | Sieverman | 439/134 |
| 5,030,119 | 7/1991 | Lowe | 439/141 |
| 5,055,057 | 10/1991 | Boyer | 439/134 |
| 5,071,360 | 12/1991 | Lindow et al. | 439/133 |
| 5,073,122 | 12/1991 | Burke, Jr. | 439/134 |
| 5,082,450 | 1/1992 | Warren, Sr. et al. | 439/102 |
| 5,171,155 | 12/1992 | Mendoza | 439/134 |
| 5,176,527 | 1/1993 | Herbert | 439/134 |
| 5,178,551 | 1/1993 | Buch | 439/133 |
| 5,190,466 | 3/1993 | McVey | 439/304 |
| 5,231,310 | 7/1993 | Oh | 307/142 |
| 5,254,019 | 10/1993 | Noschese | 439/681 |
| 5,273,445 | 12/1993 | Ehrenfels et al. | 439/134 |
| 5,277,599 | 1/1994 | Nilson | 439/133 |
| 5,330,361 | 7/1994 | Brend | 439/134 |
| 5,338,212 | 8/1994 | Kerrigan | 439/134 |
| 5,342,212 | 8/1994 | Francis | 439/149 |
| 5,393,237 | 2/1995 | Roy et al. | 439/134 |
| 5,412,550 | 5/1995 | Hsieh et al. | 362/226 |
| 5,431,572 | 7/1995 | Surrey et al. | 439/134 |
| 5,518,411 | 5/1996 | Belleci | 439/141 |

FOREIGN PATENT DOCUMENTS

| | | | |
|---|---|---|---|
| 15806 | 11/1955 | Germany | 439/133 |

*Primary Examiner*—Steven N. Meyers
*Assistant Examiner*—Donald J. Lecher
*Attorney, Agent, or Firm*—Peter Loffler

[57] ABSTRACT

A plug lock for locking electric plugs is disclosed. The device comprises a case having a shaft. The shaft has a pair of inverted U-shaped cut portions that pivot outwardly. A lock gear is rotatably disposed within the shaft and engages the cut portions pushing them outwardly. A block cap is slidably disposed on the shaft. In its extended position, the block cap blocks the electric prongs' access to an electric socket. In this position, the lock gear is rotated so that the cut portions extend outwardly, preventing the lowering of the block cap. Lock drive means control rotation of the lock gear.

3 Claims, 1 Drawing Sheet

PLUG LOCK

BACKGROUND OF THE INVENTION

1. Field of the Invention

The present invention relates to locks for use with electric appliance plugs.

2. Background of the Prior Art

Locks for use with electric appliances are well known in the art. These devices either fit onto or receive an electric plug and prevent unauthorized use of the appliance. This gives parents the ability to control use of certain appliances such as televisions and stereos. Such devices also give parents the ability to prevent use of dangerous items such as irons.

Although most devices known in the art, achieve their intended purpose of preventing unauthorized use of an electric appliance, these devices are not without their drawbacks. Many devices are complex to use and expensive to manufacture tending to reduce their purchase and subsequent use. Other devices, while of simple design, are bulky and cumbersome, again reducing their use by owners.

A device is needed that prevents unauthorized use of electric appliances yet is simple to manufacture and use. Such a device should not be cumbersome or otherwise bulky.

SUMMARY OF THE INVENTION

The plug lock of the present invention meets the above-identified needs in the art. The device comprises a base having a shaft extending therefrom. A pair of opposing inverted U-shaped cut portions are located along the length of the shaft. The cut portions can be pivoted outwardly. A lock gear, located within the shaft, engages the cut portions and controls their pivoting. A block cap is slidably disposed on the shaft such that when the block cap is in its lowered position, the top of the block cap coincides with the base of the electric prongs. In its extended position, the top of the block cap either coincides or extends beyond the tip of the electric prongs.

In order to lock the plug to prevent its insertion into an electric socket, the block cap is slid into its extended position, thereby preventing use of the electric prongs. The lock gear is rotated such that the cut portions are engaged and pivoted outwardly. The tops of the cut portions engage the bottom of the block cap thereby preventing the block cap from sliding back to its lowered position. This holds the block cap securely in its extended position.

In order to unlock the device, the lock gear is rotated so that the ends of the lock gear disengage the cut portions, permitting the lock portions to retract back into their original position. This disengages the top of the cut portions from the bottom of the block cap and permits the block cap to slide back into its lowered position. This exposes the electric prongs and permits them to be plugged into any appropriate electric socket.

Lock drive means control rotation of the lock gear. The lock drive means can comprise a simple bolt wherein the bolt engages the lock gear. The head of the bolt can of a variety of designs so that simple household tools can be used to rotate the bolt and thereby the lock drive. Alternately, the lock drive means can be a standard lock such that the key inserts into the lock and the lock's tumbler engages the lock gear.

The device can be made integrally with the electric plug, or can be manufactured separately and thereafter fitted onto existing plugs.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
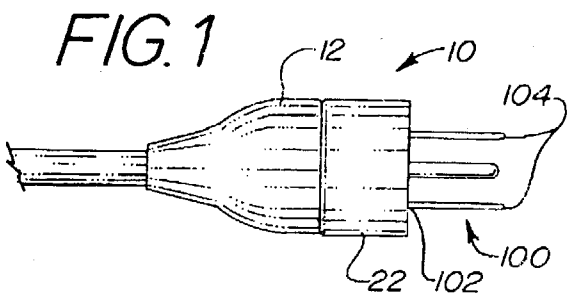
FIG. 1 is a front elevation view of the plug lock of the present invention in an unlocked position.
Figure 2:
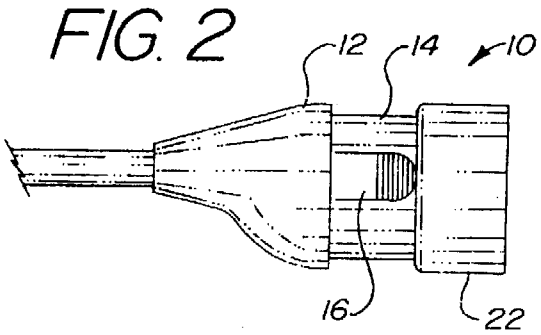
FIG. 2 is a front elevation view of the plug lock of the present invention in a locked position.
Figure 4:
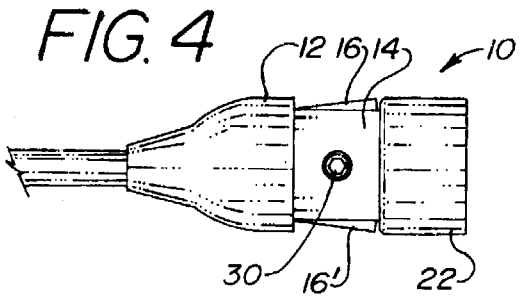
FIG. 4 is a cutaway view of FIG. 2 with the lock gear engaged.
Figure 3:
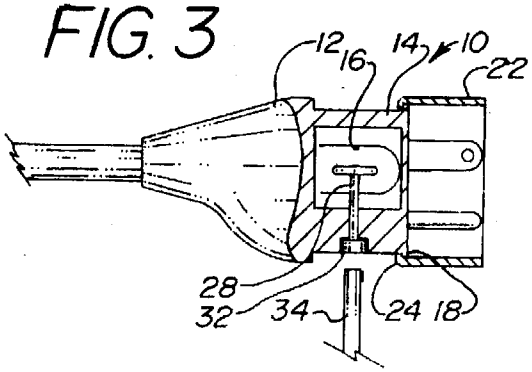
FIG. 3 is a side elevation view of the plug lock of the present invention in a locked position.
Figure 5:
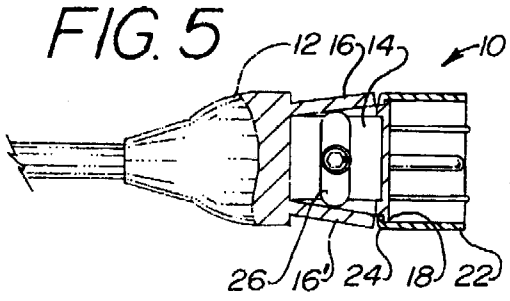
FIG. 5 is a cutaway view of FIG. 2 with the lock gear disengaged.
Figure 6:
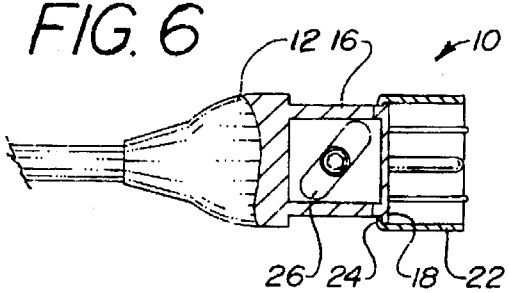
FIG. 6 is a cutaway view of FIG. 3.

Referring now to the figures it is seen that the plug lock of the present invention, generally referred to by reference numeral 10, comprises a base 12. The base 12 can be integral with the plug itself, or can be separate from the plug base.

Extending from the base 12 is a shaft 14, having a cross-section that is smaller than the cross-section of the base 12. The shaft 14 is constructed of a generally resilient, durable material such as plastic, metal or the like. A first cut portion 16 is located along the length of the shaft 14, while a second cut portion 16' is located along the length of the shaft 14, opposite the first cut portion. Each cut portion, is generally U-shaped and inverted relative to the base 12. The top of the shaft 14, which terminates at the base 102 of the electric prongs 100, is flanged 18.

A block cap 22 is slidably disposed on the shaft 14. As seen in FIG. 1, when the block cap 22 is in its lowered position, the top of the base 12 coincides with the top of the block cap 22. As seen in FIGS. 2–6, when the block cap 22 is in its extended position, the top of the block cap 22 either coincides with or is beyond the tips 104 of the electric prongs 100. In the block cap's extended position, flange 24 located on the bottom of the block cap 22 engages the flange 18 of the shaft 14, in order to prevent the block cap 22 from sliding off of the end of the shaft 14.

A lock gear 26 is rotatably disposed within the interior of the shaft 14. A lock drive 28 engages and controls rotation of the lock gear 26. The lock drive 28 can be a bolt 30 wherein the bolt 30 engages the lock gear 26. The head of the bolt can be dimensioned so that a regular wrench, an Allen wrench, a screw driver, or other similar tool can be used to rotate the bolt 30 and its engaged lock gear. Alternately, the lock drive 28 can be a standard lock 32 wherein the key 34 causes the lock's tumbler to engage the lock gear 26, or any other device that can engage or control the lock gear 26. Having a choice of lock drives 28 permits simple locking, as when small children are to be protected, to more elaborate key locking when older and more resourceful children are present.

In order to lock an electric plug 100 to prevent its use, the block cap 22 is placed into its extended position. Thereafter, the lock gear 26 is rotationally positioned so that it is traverse to the path of travel of the block cap 22, causing the ends of the lock gear 26 to push outwardly on the cut portions 16 and 16', causing the cut portions to pivot outwardly. In such a position, the tops of the cut portions 16 and 16' engage the flange 24 of the block cap 22, preventing the block cap 22 from sliding downwardly on the shaft 14 and thereby securely holding the block cap 22 in its extended position. As the top of the block cap 22 is either coincident or beyond the tips 104 of the electric prongs, the electric prongs 100 cannot be inserted into a wall or other type of socket.

In order to unlock the device, the lock gear 26 is ratably positioned so that the ends of the lock gear 26 disengage from the cut portions 16 and 16', permitting the cut portions 16 to retract to their original position. This permits the block cap 22 to clear and slide past the ends of the cut portions 16 and 16' permitting the block cap 22 to be slid into its lowered position. In this position, the top of the block cap 22 coincides with the base 102 of the electric prongs 100. In this position, the electric prongs can be freely inserted into any electric socket.

The device 10 can be used with either a two prong or three prong plug. The device 10 can also be fitted onto the ends of cables and telephone plugs in order to control their use.

While the invention has been particularly shown and described with reference to an embodiment thereof, it will be understood by those skilled in the art that various changes in form and detail may be made without departing from the spirit and scope of the invention.

I claim:

1. A plug lock for preventing the prongs of a plug from being inserted into a receptacle comprising:

a base;

a shaft having a first flange on one end extending outwardly from the base;

a first cut portion, located along the length of the shaft and attached to the shaft at a first attachment point proximate the base, that pivots outwardly from the first attachment point;

a second cut portion, located along the length of the shaft opposite the first cut portion and attached to the shaft at a second attachment point, that pivots outwardly from the second attachment point;

a block cap, slidably connected to the shaft and moving between an unlocked position wherein the prongs are exposed to a locked position wherein the prongs are enshrouded by the block cap and, having a second flange on one end that engages the first flange to prevent the block cap from being expelled off of the shaft in the locked position;

a lock gear, having a first end and a second end such that when the lock gear is perpendicularly to the travel path of the block cap the first end engages and pushes the first cut portion outwardly and the second end engages and pushes the second cut portion outwardly thereby the first cut portion and the second cut portion each engage the second flange and retain the block cap in the locked position, rotatably disposed within the interior of the shaft; and a drive means for engaging and controlling rotation of the lock gear.

2. The device as in claim 1 wherein the drive means comprises a cooperating lock and key.

3. The device as in claim 1 wherein the drive means comprises a bolt.

* * * * *